US005246502A

United States Patent [19]

Matthews et al.

[11] Patent Number: 5,246,502

[45] Date of Patent: Sep. 21, 1993

[54] METHOD OF CLEANING VALVE BUSHINGS

[75] Inventors: Alvin J. Matthews, Pittsburgh; Thomas M. Hartzell, Wilmerding; Ronald M. Markos, McKeesport; Richard H. Gumbert, North Huntington, all of Pa.

[73] Assignee: Westinghouse Air Brake Company, Wilmerding, Pa.

[21] Appl. No.: 886,260

[22] Filed: May 21, 1992

Related U.S. Application Data

[62] Division of Ser. No. 626,303, Dec. 12, 1990, Pat. No. 5,146,939.

[51] Int. Cl.[5] ..... B08B 1/00; B08B 9/00; B08B 9/04

[52] U.S. Cl. ..... 134/22.11; 134/22.12; 134/166 R; 134/166 C; 134/167 C; 134/167 R; 134/168 R; 134/168 C; 134/169 R; 134/169 C; 134/102.1; 134/172; 134/178

[58] Field of Search ..... 134/22.11, 22.12, 166 R, 134/166 C, 167 R, 167 C, 168 R, 168 C, 169 R, 169 C, 102, 172, 178; 166/191

[56] References Cited

U.S. PATENT DOCUMENTS 2,136,881 11/1938 Johnson ..... 166/191
4,765,405 8/1988 Clark ..... 166/191

FOREIGN PATENT DOCUMENTS 1002054 3/1983 U.S.S.R. ..... 134/22.11

*Primary Examiner*—Theodore Morris
*Assistant Examiner*—Zeinab El-Arini
*Attorney, Agent, or Firm*—J.O.R.

[57] ABSTRACT

A valve bushing cleaning device for cleaning a valve bushing while the bushing is situated in a valve bore of a valve body, such as in a railway vehicle brake apparatus and a method for cleaning such valve bushing. The cleaning device comprises a hollow cylindrical conduit having a first open end attachable to a source of pressurized fluid and a second closed end. The conduit has a recessed portion with fluid passageways through the wall thereof and structure for securing a sealing member on each side of the fluid passageways. In the method, the closed end of the cleaning device is inserted into a valve bushing disposed in a valve bore of a valve body, with pressurized fluid forced through the conduit, out of the fluid passageways, and through apertures in the valve bushing, with any solids picked up and carried by the fluid through passages formed in the valve body.

6 Claims, 1 Drawing Sheet

FIG. 1
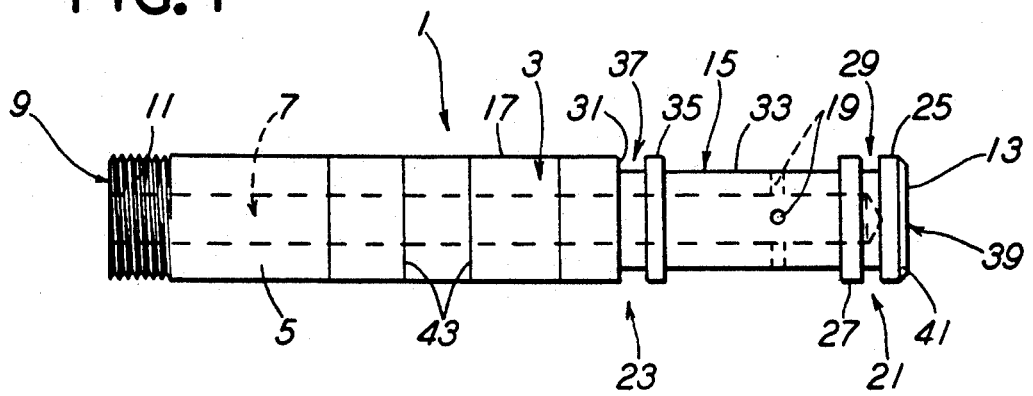
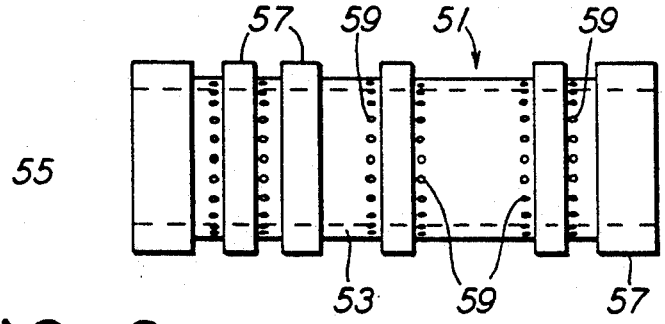
FIG. 2
PRIOR ART
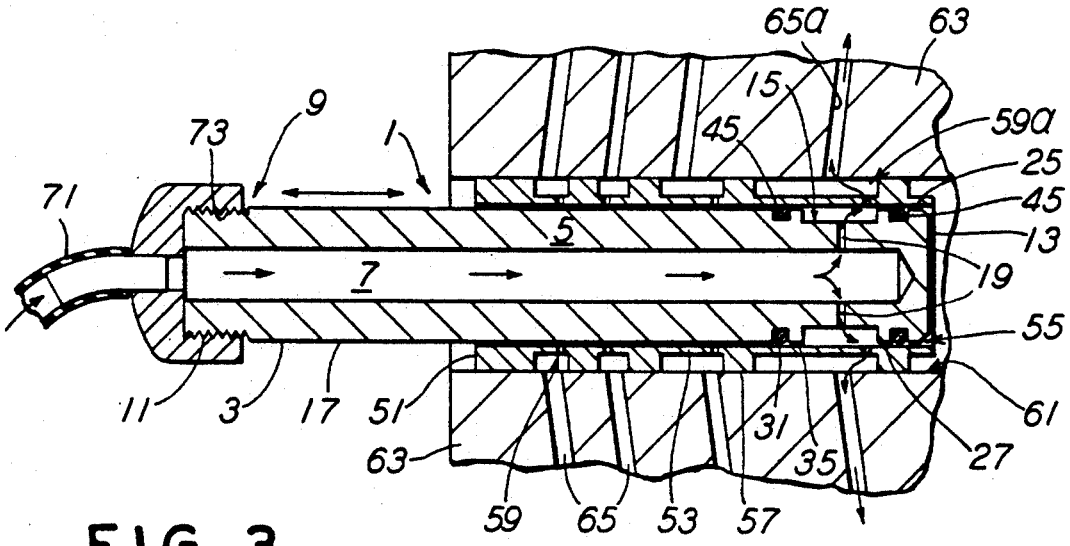
FIG. 3

METHOD OF CLEANING VALVE BUSHINGS

This is a division of application Ser. No. 07/626,303 filed Dec. 12, 1990, now U.S. Pat. No. 5,146,939.

BACKGROUND OF THE INVENTION

The present invention provides a valve bushing cleaning device and a method for cleaning a valve bushing to remove solid particles from apertures in the valve bushing wall while the bushing is situated in a valve bore of a valve body, the valve body having fluid passages therein which communicate with the valve bore.

The valve bushing cleaning device is usable to clean the valve bushings that are contained in a valve body of various braking devices, such as the fluid pressure braking devices used in vehicles, such as trucks, and in railway vehicles. A primary use, however, is in the cleaning of valve bushings of a railway vehicle fluid pressure braking device, whether for new valve bushings in the assembly of original equipment or for rebuilt or serviced valve bushings in existing equipment.

In a fluid pressure brake apparatus for railway vehicles, such as brake controls for an electric or diesel-electric locomotives when used in freight service, passenger service or as switchers and controlling brakes on a multiple unit, such as subway cars, the apparatus contains valve bores that communicate with passages in a valve body, with valve bushings having apertures through the wall thereof, selectively charging fluid, such as air, to various passages to effect operation of brake components. Such a fluid pressure brake apparatus is described, for example, in U.S Pat. No. 2,958,561, issued Nov. 1, 1960 to Harry C. May and in U.S. Pat. No. 3,504,950, issued Apr. 7, 1970 to Glenn T. McClure, both of which were assigned to the assignee of the present invention, and the contents of both said patents are incorporated by reference herein. The brake apparatus described in these two patents has been designated in the industry as the 26 Brake Valve and has been in use for a period of time. This air brake device is tested for discharge at regular intervals without removing the brake valve from a locomotive.

At periodic intervals, namely within any twenty-four month period of operation, the brake valve is removed from the equipment and is completely dismantled, with the various parts of the brake valve cleaned, inspected, lubricated, reassembled and tested. New rubber parts, such as O-ring seals and other new parts, as specified in maintenance specifications are inserted at this time.

It has been found, during periodic maintenance intervals, that bushings used in the brake valve, which have passageways through the wall of the bushing, can collect minute particles of rubber components, which may have worn or deteriorated to an extent from O-ring seals, and also minute rust or scale particles that result from condensation or other oxidation in the brake valve device. Such minute solid particles which have usually collected in the interior chamber of a valve bushing, or in the valve chamber can find their way into the passageways through the wall of the valve bushing and cause plugging of such passageways. The cleaning of the valve bushings and valve chambers is generally carried out by soaking the valve device in a solvent, such as mineral spirits, and then forcing air through passages in the valve body to dislodge minute particles. This procedure, however, poses a problem in that minute particles can become entrapped in passageways in the wall of the valve bushing which requires that the bushing be removed from the valve chamber, cleaned separately and then returned to the valve chamber, which results in added expense in time and labor involved.

It is an object of the present invention to provide a valve bushing cleaning device that can be used to clean a valve bushing that is positioned in a valve bore of a valve body.

It is another object of the present invention to provide a method for cleaning a valve bushing that is positioned in a valve bore of a valve body.

SUMMARY OF THE INVENTION

A valve bushing cleaning device is provided for cleaning a valve bushing having apertures in the wall thereof, while the valve bushing is disposed in a valve bore of a valve body, the valve body having fluid passages that communicate with the interior chamber of the valve, bushing through apertures in the wall of the valve bushing. The valve bushing cleaning device comprises a hollow cylindrical conduit with a first open end adapted to be connected to a source of fluid pressure and a second closed end. A recessed portion is formed in the outer surface of the wall of the hollow cylindrical conduit and a plurality of fluid passageways are formed through the wall at the recessed portion. A sealing member is provided on the outer surface of the hollow cylindrical conduit, spaced from and on each side of the passageways.

The sealing members preferably comprise O-rings, with a first O-ring frictionally secured in a first gap formed between an end section adjacent the closed end of the conduit and a first spaced outwardly extending flange on the conduit, and a second gap formed between a shoulder between the outer surface of the conduit and the recessed portion and a second spaced outwardly extending flange. The first open end of the hollow cylindrical conduit has threads to enable engagement with a source of fluid pressure, while the second closed end preferably has a bevelled section formed around the periphery to enable easy insertion into an interior chamber of a valve bushing.

According to the method of the present invention, the valve bushing cleaning device is provided and sealing members secured on the hollow cylindrical conduit on each side of the fluid passageways. The closed end of the valve bushing cleaning device conduit is inserted into the valve bushing, which is disposed in a valve bore of a valve body, such that the plurality of fluid passageways are adjacent apertures in the wall of the valve bushing that are to be cleaned, with a sealing member providing a seal between the hollow cylindrical conduit and the wall of the valve bushing on both sides of the apertures to be cleaned. A pressurized fluid is forced through the open end of the conduit, such that the fluid is forced through the fluid passageways in the wall of the conduit and then through the apertures in the wall of the valve bushing to dislodge solid particles in the apertures, which solids are entrained in and carried by the fluid through the fluid passages in the valve body and discharged therefrom.

BRIEF DESCRIPTION OF THE DRAWINGS

The invention will become more readily apparent from the following descriptions of a preferred embodiment thereof shown, by way of example only, in the accompanying drawings, wherein:

FIG. 1 is an elevational view of a valve bushing cleaning device, before securement of sealing means, for use in the present method;

FIG. 2 is an elevational view of a valve bushing such as that to which the method of the present invention is directed; and FIG. 3 is a cross-sectional view of the valve bushing cleaning device of FIG. 1 inserted in the valve bushing shown in FIG. 2, while the valve bushing is disposed in a valve bore of a valve body, illustrating the method of cleaning.

DETAILED DESCRIPTION

The valve cleaning device of the present invention is useful in the method of the present invention to clean a valve bushing, having apertures in the wall thereof, while the valve bushing is disposed in a valve bore of a valve body. As with previous cleaning methods, the valve body and its component parts may first be soaked in a solvent, such as mineral spirits, to loosen and soften minute particles that have collected in the valve system.

Referring now to the drawings, FIG. 1 illustrates a valve bushing cleaning device 1 for use in the present method of cleaning a valve bushing, disposed in a valve bore of a valve body, to remove solid particles therefrom. The valve bushing cleaning device 1 comprises a hollow cylindrical conduit 3 having a wall 5 and an interior hollow 7 defined by the wall. The cylindrical conduit 3 has a first open end 9 which is adapted to be connected to a source of fluid pressure, such as by the use of threads 11 on the outer surface of the wall 5, and a second closed end 13. A recessed portion 15 is provided in the outer surface 17 of the wall 5 of the cylindrical conduit 3, preferably adjacent the closed end 13 thereof. A plurality of fluid passageways 19 are formed through the recessed portion 15 of wall 5 at a location spaced from the closed end 13. Preferably four such passageways 19 are provided substantially equidistant about the circumference of the cylindrical conduit 3, which passageways 19 preferably extend through .the wall 5 in a radial direction relative to the longitudinal axis of the cylindrical conduit 3. First and second means 21, 23 for securing a sealing member on the outer surface 17 of the wall 5 of the cylindrical conduit 3 are provided, one on each side of, and spaced from the plurality of the fluid passageways 19. As illustrated, first means 21 for securing a sealing member may comprise the end section 25 of the wall 5 adjacent the closed end 13 of the cylindrical conduit 3 and a first spaced outwardly extending flange 27, such that a sealing member may be secured in a first gap 29 between the end section 25 and first flange 27. The second means 23 may comprise a shoulder 31 between the outer surface 17 of the wall 5 of the cylindrical conduit 3 and the outer surface 33 of the recessed portion 15, and a second spaced outwardly extending flange 35, such that a sealing member may be secured in a second gap 37 between the shoulder 31 and the second flange 35. The gaps 29 and 37 are preferably designed to frictionally secure a sealing member such as an O-ring therein. The outer end surface 39 of the closed end 13 of the cylindrical conduit 3 is preferably formed with a beveled portion 41 around the periphery thereof to aid in easy insertion of the valve bushing cleaning device 1 into the cavity of a valve bushing. Depth indicia, such as line marks 43, may be provided on the surface 17 of the cylindrical conduit 3.

FIG. 2 illustrates a typical valve bushing 51 for which the valve bushing cleaning device of the present invention is used and to which the method of the present invention is applied. Such valve bushings 51, which are well known in the art, have a wall 53 surrounding an interior chamber 55 through the valve bushing, with spaced raised sections 57 on the wall which face the inner wall of a valve bore. The wall 53 has a plurality of spaced series of apertures 59, between the raised sections 57, at predetermined locations through the wall 53 which provide for fluid flow between the interior chamber 55 and the exterior of the valve bushing 51 when the valve bushing 5 is disposed within a valve bore of a valve body. It is the apertures 59 which, over the course of use of the valve, can become clogged by minute solid particles. The apertures 59 provide fluid communication from the interior chamber 55 of the valve bushing 51 with fluid passageways in the valve body in which the valve bushing is used. The present method is directed to cleaning of these apertures 59 in a valve bushing 51 while the valve bushing 51 is disposed in a valve bore of a valve body.

The use of the valve bushing cleaning device 1 for cleaning of a valve bushing 51 disposed in a valve bore 61 of a valve body 63, the valve bore body 63 having fluid passages 65, which communicate with the valve bore 61, is illustrated in FIG. 3. As illustrated, a valve bushing cleaning device 1 is provided which has sealing members, such as O-rings 45 on the hollow cylindrical conduit 3 of the device 1, in the first and second gaps 29, 37, one of which is on each side of the plurality of fluid passageways 19 through the wall 5 of the device 1. The closed end 13 of the valve bushing cleaning device 1 is inserted in the valve bushing 51, disposed in the valve bore 61 of the valve body 63, such that the fluid passageways 19 are adjacent selected apertures 59 in the wall 53 of the valve bushing 51, which apertures 59 provide fluid communication from the interior chamber 55 of the valve bushing with fluid passages 65 in the valve body 63. As illustrated, where a series of apertures 59*a* are to be cleaned, the hollow cylindrical conduit 3 is inserted into the valve bushing 51 such that the plurality of fluid passageways 19 are adjacent the apertures 59*a* in the wall 53 of the valve bushing 51, with the sealing members, such as O-rings 45 providing a seal between the hollow cylindrical conduit 3 and the wall 53 of the valve bushing on both sides of the series of apertures 59*a* to be cleaned. A fluid, such as air, under, pressure, from a source (not shown) is directed through a line 71 which has a threaded section 73 threadedly secured to the threads 11 on the hollow cylindrical conduit, and forced through the open end 9 of the conduit 3. The pressurized fluid is forced into the interior hollow 7 and through the fluid passageways 19 in the wall 5 of the conduit 3 as illustrated by the arrows in FIG. 3. The fluid, which is retained between the sealing members 45 will then be forced through the apertures 59*a*. Forcing of the fluid through the fluid passageways 59*a* dislodges and removes solids, and any solids entrained in and carried by the fluid are passed through the fluid passages 65*a* in the valve body 63 and such solids are discharged therefrom.

The fluid used in the present method is preferably pressurized air, with the air being at a pressure of less than about 30 pounds per square inch.

The indicia 43, such as score lines are used to readily determine the depth of the conduit into the valve bushing so that the fluid passageways through the cleaning device may be positioned adjacent particular series of apertures in the valve bushing that are to be cleaned. The location of the depth indicia may be varied dependent upon the particular valve bushing that is to be cleaned by the cleaning device.

What is claimed is:

1. A method of cleaning a valve bushing disposed in a valve bore of a valve body, to remove solid particles from apertures disposed through a wall of said valve bushing, which provide fluid communication from an interior chamber of said valve bushing to fluid passages disposed in said valve body, said method comprising the steps of:

(a) providing a valve bushing cleaning device including a hollow cylindrical conduit having a wall, a first open end equipped to be connected to a source of fluid pressure, and a second closed end, said conduit having a plurality of fluid passageways formed through said wall, and means for securing a sealing member on an outer surface of such wall of said conduit on both sides of said plurality of passageways;

(b) securing sealing members on said conduit in each of said means for securing sealing members;

(c) inserting such second closed end of said conduit into said valve bushing, disposed in such valve bore of said valve body, such that said plurality of fluid passageways are adjacent such apertures in such wall of said valve bushing which are to be cleaned;

(d) providing a seal between said conduit and said wall of said valve bushing on both sides of said apertures to be cleaned with such sealing members;

(e) forcing a fluid under pressure through such first open end of said conduit such that fluid is forced through such fluid passageways in such wall thereof and through said apertures in such wall of such valve bushing to remove solids therefrom; and (f) carrying said solids by said fluid through such fluid passages in such valve body and discharging said solids therefrom.

2. The method of cleaning a valve bushing disposed in a valve bore of a valve body, according to claim 11, wherein said plurality of passageways through such wall of said conduit are radially extending passageways and said fluid is forced through such radial passageways in a radial direction.

3. The method of cleaning a valve bushing disposed in a valve bore of a valve body, according to claim 11, wherein said fluid comprises air.

4. The method of cleaning a valve bushing disposed in a valve bore of a valve body, according to claim 3, wherein said air is pressurized air at a pressure of less than about 30 pounds per square inch.

5. The method of cleaning a valve bushing disposed in a valve bore of a valve body, according to claim 11, wherein said valve bushing is disposed in a valve bore of a valve body of a fluid pressure brake apparatus for railway vehicles.

6. The method of cleaning a valve bushing disposed in a valve bore of a valve body, according to claim 11, wherein said valve bushing and valve bore body are soaked in a solvent to loosen and soften minute particles that have collected therein prior to inserting said second closed end of said conduit into such valve bushing.

* * * * *

UNITED STATES PATENT AND TRADEMARK OFFICE
CERTIFICATE OF CORRECTION

PATENT NO. : 5,246,502

DATED : 9/21/93

INVENTOR(S) : Alvin Matthews et al.

It is certified that error appears in the above-identified patent and that said Letters Patent is hereby corrected as shown below:

Column 2, line 20, delete "," after valve
column 4, line 13, delete "5" and insert --51--
column 4, line 48, delete "," after under
column 5, line 21, delete "such" and insert --said--
column 5, line 26, delete "such" and insert --said--
column 5, line 27, delete "such" and insert --said--
column 5, line 29, delete "such" (1st occurrence) and insert --said--
column 5, line 29, delete "such" (2nd occurrence) and insert--said--
column 6, line 1, delete "such" and insert --said--
column 6, line 3, delete "such" (1st occurrence)and insert--said--
column 6, line 3, delete "such" (2nd occurrence) and insert--said--
column 6, line 4, delete "such" and insert --said--
column 6, line 5, delete "such" and insert --said--
column 6, line 7, delete "such" and insert --said--
column 6, line 8, delete "such" and insert --said--
column 6, line 11, delete "11" and insert --1--
column 6, line 12, delete "such" and insert --said--
column 6, line 14, delete "such" and insert --said--
column 6, line 17, delete "11" and insert --1--
column 6, line 24, delete "11" and insert --1--
column 6, line 29, delete "11" and insert --1--
column 6, line 33, delete "such" and insert --said--

Signed and Sealed this

First Day of November, 1994

*Attest:*

Bruce Lehman

BRUCE LEHMAN

*Attesting Officer*

*Commissioner of Patents and Trademarks*